United States Patent [19]

Maggart

[11] 4,438,597

[45] Mar. 27, 1984

[54] ADJUSTABLE HINGE MOUNT

[75] Inventor: Michael J. Maggart, Cherry Hill, N.J.

[73] Assignee: Eljo Products, Inc., Pennsauken, N.J.

[21] Appl. No.: 325,210

[22] Filed: Nov. 27, 1981

[51] Int. Cl.[3] ..... E06B 3/00

[52] U.S. Cl. ..... 49/501; 16/242; 16/248; 49/399; 49/400; 49/504

[58] Field of Search ..... 49/501, 504, 381, 399, 49/400; 16/235, 236, 237, 238, 243, 248, 242

[56] References Cited

U.S. PATENT DOCUMENTS

| | | | |
|---|---|---|---|
| 734,635 | 7/1903 | Tribe | 16/129 |
| 1,185,233 | 5/1916 | Minnis | 16/129 |
| 1,288,907 | 12/1918 | Johnson | 16/129 |
| 1,323,754 | 12/1919 | Gogay | 49/399 |
| 1,323,757 | 12/1919 | Gogay | 49/504 X |
| 1,323,758 | 12/1919 | Gogay | 49/504 X |
| 1,742,455 | 1/1930 | Walter et al. | 16/129 |
| 2,373,955 | 4/1945 | Fuller | 16/129 |
| 2,581,104 | 1/1952 | Houlsby, Jr. | 16/129 |
| 2,611,921 | 9/1952 | Weidelstam | 16/129 |
| 2,615,194 | 10/1952 | Kreiner | 16/129 |
| 2,626,433 | 1/1953 | Murch . | |
| 2,681,245 | 6/1954 | Ackermans | 49/399 X |
| 2,700,789 | 2/1955 | Cornwell | 16/129 |
| 2,725,589 | 12/1955 | Papesh | 16/129 |
| 2,836,269 | 5/1958 | Anderson | 49/399 |
| 2,853,162 | 9/1958 | David et al. | 49/399 X |
| 2,923,027 | 2/1960 | Bury | 16/129 |
| 3,041,023 | 6/1962 | Odlum et al. | 248/16 |
| 3,120,024 | 2/1964 | Sherwood | 16/135 |
| 3,263,368 | 8/1966 | Hildum et al. | 49/382 |
| 3,596,307 | 8/1971 | Kolmetsky | 16/129 |
| 3,690,037 | 9/1972 | Kempel | 49/399 X |
| 3,748,689 | 7/1973 | Grunert | 16/129 |
| 3,903,566 | 9/1975 | Grünert | 16/137 |
| 3,906,670 | 9/1975 | Burton | 49/381 |
| 3,949,526 | 4/1976 | Sherlock et al. | 49/501 |
| 4,087,942 | 5/1978 | Herrmann | 49/501 |
| 4,142,271 | 3/1979 | Busse | 16/129 |

*Primary Examiner*—Philip C. Kannan

*Attorney, Agent, or Firm*—Steele, Gould & Fried

[57] ABSTRACT

A door frame or jamb and hinge mount which is at once pre-hung and adjustable comprises a mounting bracket positionable immediately behind the body of the frame for rigid attachment to a hinge leaf disposed at a cutout in the frame and adjustable attachment to the frame body, via bolts. A cavity between the frame body and the structural material to which it is attached encompasses the mounting bracket and allows a range of vertical and horizontal adjustment, oversized adjustment holes allowing relative movement between the mounting bracket and the body when the bolts are loosened, notches in the periphery of the adjustment holes dimensioned to rest against the bolts attaching the bracket to the body, the notches indicating a known alignment of the hinge leaf and mounting bracket therefor, whereby the hinges can be set up at standardized positions and thereafter adjusted as required.

9 Claims, 7 Drawing Figures

ADJUSTABLE HINGE MOUNT

BACKGROUND OF THE INVENTION

1. Field of the Invention

This invention relates to the field of adjustable hinge mounts for doors, and in particular to an adjustable hinge mount disposed in a door frame, and particularly adapted to correct the alignment of pre-hung doors which may become misaligned due to settling and temperature cycling.

2. Description of the Prior Art

The usual metal door frame and/or door is constructed of relatively thin sheet material. Often the sheet material for a door is placed around a filler or a frame, usually of wood. A comparable frame or jamb is generally also of thin metal, and is attached to wooden members secured at the edges of the door opening at roughly the required position of the frame. In order to provide a secure attachment for hinges, notwithstanding the thinness of the material on which hinges are mounted, a mounting bracket of substantially heavier metal has been attached to the inner surface of the body of a door. Reference may be made to U.S. Pat. Nos. 1,323,757 and '758—Gogay, 2,853,162—David et al and 3,690,037—Kempel. Such mounting brackets may be flat (e.g., Kempel) or indented (e.g. Gogay), whereby the hinge leaf attached to the mount may be flush mounted. Two hinge leaves, rotatably attached to one another, are secured respectively to the frame or door-jamb upon which the door swings and to the door itself.

Mounting brackets such as those disclosed in the foregoing patents provide a secure attachment for the hinge leaf via screws passing through the hinge leaf and threaded into the mounting bracket. The mounting bracket rather than the hinge leaf is directly attached to the body of the door. The forces to which the door is subjected are spread over a relatively large area as the mounting bracket is substantially longer than the hinge leaf, the mounting bracket being attached to the door body at or near its ends, relatively far from the hinge leaf.

Usually the mounting bracket is welded directly to the inner surface of the metal door body (e.g., Gogay '757) but may be bolted to the door body or attached by a combination of bolts and welds (e.g., Gogay '758). Of course welding or otherwise permanently attaching the mounting bracket to the hinging body precludes any adjustment. Such is the usual condition for "pre-hung" doors or frames, the positions of the hinge mounts being precisely set at the factory and immovably locked.

U.S. Pat. No. 3,690,037—Kempel discloses an adjustable mount for a door, wherein a mounting bracket is at first only loosely mounted inside a metal door body by means of slack rivets extending through oversized holes in the body. There is no direct attachment between the mounting bracket and the door body, other than that provided upon assembly, when the continuous sheet material of the door body at and adjacent the hinge leaf is clamped between the hinge leaf and the mounting bracket by tightening the screws extending through the hinge leaf and through oversized holes in the door body, into the bracket.

The Kempel adjustable mounting means lacks any reference to an aligned position of the door. When a door according to the Kempel disclosure is built or mounted, a user must take care to set the hinges at an appropriate position within the range of adjustment.

Inasmuch as no means of defining a central or starting position is provided, the user must manually move the door or mounting bracket with respect to one another across the range of adjustment, holding the same at or near the desired part of the range of adjustment before tightening the screws attaching the hinge leaf to the mounting bracket, thereby rigidly connecting the hinge leaf and the door body. The procedure is necessary both upon installation and upon later adjustment. The adjustment technique can preclude any subsequent adjustment if any of the brackets are accidentally left at the wrong extreme of the range of adjustment. In addition, the respective axes of rotation defined by each of a series of hinges can thereby become accidentally misaligned, making the door difficult to swing, subject to warping or even inoperable.

As a building settles, doorjambs tend to deform into the shape of a parallelogram, and may also lean inwards or outwards with respect to the swing of the door. Since the hinged side of the doorjamb is likely to be attached to a heavier structural member than the latch side, the latch side of the doorjamb will not remain aligned, but will sink relative to the other side, in which event the edge of the door body must be planed or the hinges must be readjusted in order to avoid contact between the door body and the horizontal members of the doorjamb. If the doorjamb leans inward or outward, the door will tend to swing open or closed when unlatched, necessitating adjustment of the hinges to bring the hinging axis back to vertical. These same problems in alignment can also occur as a result of errors in construction of a new doorjamb.

The present invention concerns an adjustable hinge mount for a door in which one or both of the door and frame are "pre-hung". The door may be initially mounted with each of the hinges at corresponding known alignments, and thereafter conveniently adjusted within a range of adjustment to correct misalignment, sagging or leaning of the doorjamb. Separate fasteners rigidly attach the hinge leaf to the mounting bracket and rigidly but adjustably attach the mounting bracket to the body of the frame and/or door. The hinges are set at standard positions by mounting the hinge leaves at a known alignment on the jamb or door, the position tactilely indicated by notches in the adjustment holes. Preferably the notches indicate the extreme which will permit maximum adjustment of the door in the direction the doorjamb is expected to sag. The notches in the adjustment holes are dimensioned to encompass the bolts attaching the mounting bracket to the body, forming detents at which the body and mounting bracket may be initially connected. The entire range of adjustment is therefore reserved, while the "pre-hung" door is at least initially automatically and precisely aligned with the jamb.

The adjustable hinge mount of the invention is preferably placed in the door frame, whereby the hinging axis can be adjusted to plumb. In this manner, the vertical position of the door, the hinging axis and the fit of the door against the stops can be each precisely set. The adjustable mount may be set in the door as well, however, not all the foregoing adjustments are thus provided.

SUMMARY OF THE INVENTION

It will be appreciated that a "pre-hung" frame or door is one having precisely aligned hinge mounts which are fixed in position, usually at the factory. The idea of an adjustable pre-hung door mount is therefore somewhat of a contradiction in terms. It is an object of this invention to provide the advantages of both and the disadvantages of neither.

It is an object of this invention to provide a simple and effective means of mounting and adjusting the hinges of doors.

It is another object of this invention to reserve the entire range of adjustment in an adjustable hinge mount for a door by tactilely indicating a known alignment at an extreme of the range of adjustment.

It is also an object of this invention to maximize effectiveness and minimize cost in an adjustable hinge mount for both pre-hung and custom fitted doors.

It is yet another object of this invention to conveniently permit mounting of hinges at a central, known alignment and thereafter to permit convenient adjustment over a restricted range, in order to correct scraping of the mounted door in its jamb as well as tendency of the door to swing open or closed.

These and other objects are accomplished by an adjustable hinge mount for a hingeably connected body such as a door frame or door, the door to be rotatably attached to the doorframe by a hinge having a hinge leaf, the leaf to be securely attached to the body, the adjustable mount comprising: the body defining and enclosed area; a mounting bracket positionable against the body within the enclosed area, the mounting bracket having means for rigidly attaching the hinge leaf thereto and the enclosed area having a cavity encompassing the mounting bracket as well as clearance for vertical and horizontal movement of the mounting bracket over a range of adjustment; and, a plurality of fasteners for rigidly attaching the mounting bracket to the body, the fasteners extending through the mounting bracket and also extending through the body via adjustment holes in said body, the adjustment holes having a periphery larger than the fasteners to allow for adjustment over the range, notches in the periphery of the adjustment holes dimensioned to rest against the fasteners, indicating a known alignment of the mounting bracket with respect to the body. The hinge leaf is preferably flush mounted at an opening in the body provided for that purpose, the mounting bracket having a recessed central segment for attachment to the hinge leaf and threaded flanges attachable to the door jamb via bolts through the adjustment holes. The adjustment holes are substantially rectangular, but are longer in a horizontal direction, in which the notches are formed, than in a vertical direction. Adjustment holes for hinge mounts at the top or bottom of the jamb are larger than the adjustment holes on the opposite end thereof, whereby the range of adjustment is restricted.

BRIEF DESCRIPTION OF THE DRAWINGS

There are shown in the drawings the embodiments of the invention which are presently preferred. It should be understood, however, that the invention is not limited to the precise arrangements and instrumentalities depicted.

DETAILED DESCRIPTION OF THE PREFERRED EMBODIMENTS

Figure 1:
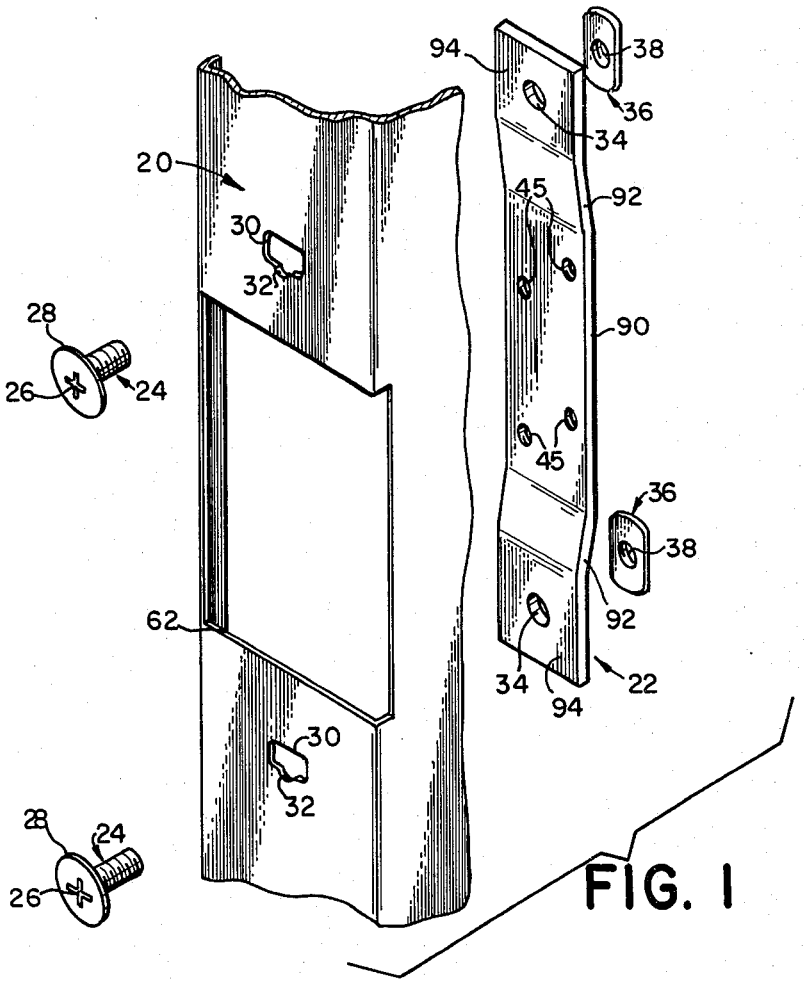
FIG. 1 is an exploded perspective view of an adjustable hinge mount according to this invention, the body of the hinged member shown partially cut away.

The adjustable mounting means according to the invention is shown in FIG. 1, the hinge leaf omitted and the remaining parts exploded from one another. Hinging body 20 is constructed of a thin sheet metal material such as steel or aluminum, a few millimeters thick. The body 20 is a door frame member or a door body, the invention being applicable to both. The door is formed in the shape of a box; the frame is formed in an inverted "U" only slightly larger than the door, roughly seven feet by three feet by two inches. Preferably, the frame is formed from two separate vertical members rigidly attachable to a single upper horizontal header.

A portion of the hinged edge of body 20 is shown in FIGS. 1–7, cut away from the balance of the body. In this context the body can be the door body or the frame body adjacent the hinged edge of the door. As noted above, the frame is formed from separate upper and vertical side members. The member forming the adjustably hinged edge of a door can also be contructed as a separable member attached to the edge of a door body, for example to standardize a body to doorjambs over a range of sizes. Alternatively, the mount can be placed directly in the hinged edge of a unitary body. The same is applicable to adjustably hinged jambs, or both doors and jambs.

The thin material of the body is usually relatively weak, that is, subject to bending due to various forces occurring in normal actuation of the door. Accordingly, various internal frameworks are sometimes employed, particularly in door bodies. The invention is also applicable to doors and jambs of thicker or nonmetallic material, of different overall dimensions, and, subject to the requirement of a cavity for the adjustment bracket, solid doors. The invention is likewise applicable to both front-mounted and edge-mounted hinges, but will be described herein with reference to edge-mounted hinges and metallic door and frame bodies.

In building the frame and hanging the door, the craftsman begins with a rough opening, frames and shims the opening to nearly the required size, then attaches the metal frame pieces to the framed opening using screws or nails. During this procedure, every effort is made to maintain the frame sides at vertical and precisely parallel. Even with the greatest care, slight misalignment is common. According to the invention, the vertical frame member on the hinge side is equipped with adjustable mounts that are aligned and affixed at the correct position for a perfectly mounted frame. Should an error occur in setting the frame, correction is not difficult. Similarly, should the frame become misaligned as the structure settles, the hinging axis and the vertical and horizontal position of the hinge mounting means may be re-set to correct the problem.

In order to provide a secure but adjustable and aligned mount for the hinges, a mounting bracket 22 is provided at the hinged edge of one or both hinged bodies, securely mountable to a hinge leaf using screws for threaded holes 45, spaced to conform to holes in the leaf, and adjustable and securely mounted to the hinged body via bolts or screws 24. Oversized adjustment holes 30 in the body allow a range of relative movement between the mounting bracket 22 and body 20 when bolts 24 are loosened, bracket 22 being otherwise rigidly attached to body 20 by means of bolts 24. Bracket 22 is positioned on the inner side of body 20 immediately behind cutout 62 therein but extending beyond cutout 62 to the area of adjustment holes 30. Cutout 62 is provided to allow access to bracket 22 whereby a hinge leaf may be flush mounted at the surface of the hinged edge. The hinge leaf itself plays no part in the adjustment and in fact may be permanently attached to the bracket. Bolts 24 are passed through adjustment holes 30, through bracket mount holes 34, and threaded into weldnuts 36. It will be appreciated that bracket mounting holes 34 could themselves be threaded, such that weldnuts 36 with their threaded holes 38 would not be required. Alternatively, press-fit threaded members can replace the weldnuts. Use of the additional member 36 in addition to the bracket 22 provides a greater width of thread and is stronger than a simple threaded bracket.

Adjustment bolts 24 may be provided with phillipstype screwdriver slots 26, regular screwdriver slots, or oversized head 28 may be formed in the hexagonal shape of the usual bolt. Bolt 24 includes an oversized head 28 in order to conceal adjustment hole 30, presenting a neater appearance. It is also preferable to use a head 28 of substantial size to avoid confining the force of bolt 24 to a small area and thus bending or marring the body material at and adjacent the adjustment hole 30.

Upon initially mounting the hinges to the hinged body, bolts 24 are nestled in notches 32 formed in a central area of the horizontal edges of oversized holes 30. Notches 32 are preferably placed in the lower horizontal edge of holes 30 on either the door or jamb or both. Such holes in the frame permit the door to be raised in the jamb raising the hinge mounts. Such holes in the door permit the door to be lowered in the jamb by lowering the door body with respect to the hinges. The notches may be placed in the upper horizontal edges to reverse the span of adjustment. In any of these situations, horizontal adjustment is possible as the notches are centered.

Whether the hingemounts are initially assembled at their upper or lower extreme of adjustment, the centering notches 32 ensure correct alignment. In contrast with prior art adjustment techniques, the apparatus of the present invention includes a tactile indication that the hingemounts are aligned, and even if assembled at the job site as opposed to the factory, correct alignment may be achieved by placing bolts 24 in centering notches 32. The mount is at the same time pre-hung and adjustable because the notches are cut to alignment with factory precision. The craftsman need only mount the hinge, as thus aligned, on the mounting brackets. Since the centering notches of each hingemount are aligned with one another, the axes of rotation are aligned, whereby the door will swing freely.

Figure 2:
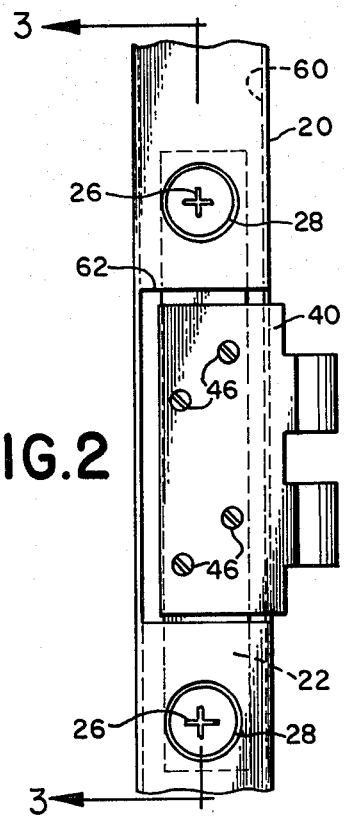
FIG. 2 is a side elevation view of the assembled adjustable hinge mount.
Figure 3:
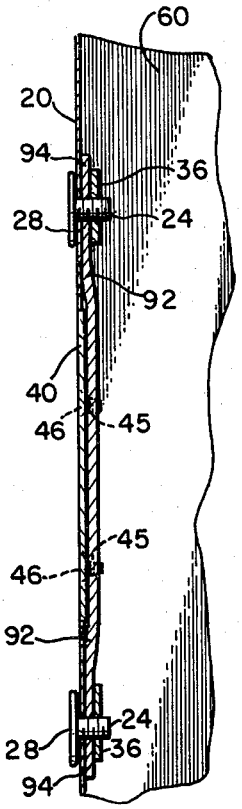
FIG. 3 is a section view taken along lines 3—3 in FIG. 2.

With reference to FIGS. 2 and 3, mounting bracket 22 having been positioned on the inner or enclosed area 60 of hinged body 20, and attached via bolts 24, hinge leaf 40 is attached directly to the mounting bracket. The mounting bracket includes a central flat portion 90, having threaded holes 45 for attachment of the hinge leaf via screws 46. A span of adjustment commensurate with the spacing permitted bolts 24 in oversized holes 30 must be provided in cutout 62, in which hinge leaf 40 is flush mounted. Hinge leaf 40 is flush mounted by virtue of flanges 94 and angled connection members 92, flanges 94 boltable directly to the body and connected via members 92 to flat bracket member 90, thereby positioned below the surface of the body material at the same spacing as the width of hinge leaf 40. Bracket 22 may be stamped into this segmented shape from flat stock, such as 10 gauge steel.

Figure 4:
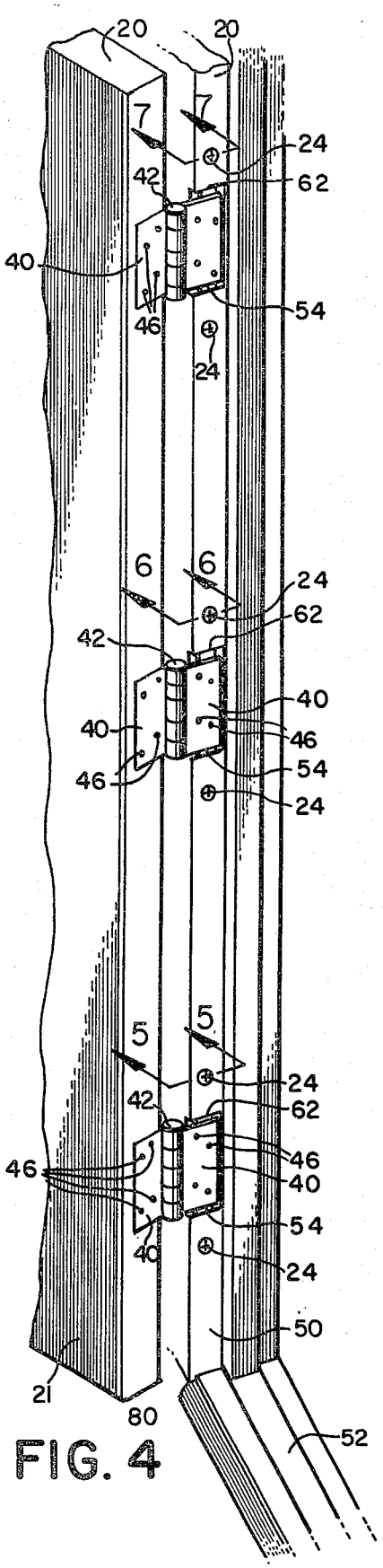
FIG. 4 is a perspective cutaway view of a mounted door according to the invention.

Hinge leaf 40 is rigidly attached to mounting bracket 22 by screws 46, and mounting bracket 22 is adjustably but rigidly attached to body 20 by bolts 24. The mounting bracket and/or the hinge leaf may be affixed to either or both of the frame and door bodies before the door is mounted, the door then being mounted by normal procedures for pre-hung doors or merely by attaching the respective hinge leaves by a hinge pin. With reference to FIG. 4, having pre-aligned mounting brackets, the remainder of the mounting procedure is not remarkable. The hinge leaves 40 are attached respectively to brackets 22 in door 21 and/or in doorjamb 50 (both being "hinged bodies" 20). The leaves 40 are rotatably attached to one another by pins 42.

The hinge leafs mounted on one of the hinged bodies can be directly attached in the traditional manner, such as using screws driven into the body material, without losing the benefits of the invention. As is known in the art, the hinge leafs may be thus attached to a wood door or jamb by chiseling indentations for flush mounting the hinge leaves, and then attaching the hinge leaves via wood screws. For nonadjustable metal bodies, indentations are sometimes provided for the hinge leaves, machine screws attaching the hinge leaves to the body via threaded holes.

Figure 5:
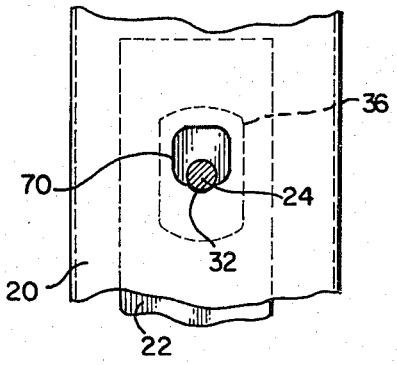
FIG. 5 is a partial section view taken along lines 5—5 in FIG. 4, immediately behind the bolt head.
Figure 6:
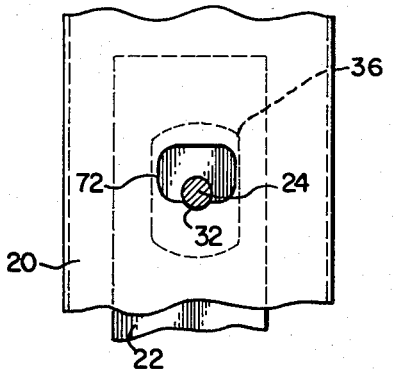
FIG. 6 is a partial section view taken along lines 6—6 in FIG. 4, immediately behind the bolt head.
Figure 7:
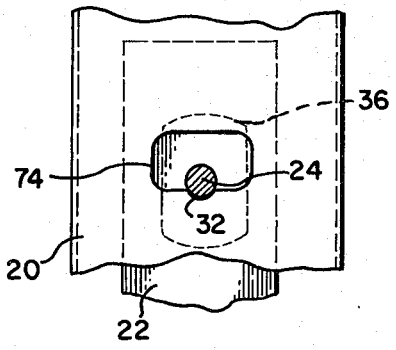
FIG. 7 is a partial section view taken along lines 7—7 in FIG. 4, immediately behind the bolt head.

FIGS. 5, 6 and 7 illustrate the preferred range of adjustment for the lower, middle and upper mounting brackets. As shown in FIG. 5, oversized hole 70 is relatively smaller in horizontal dimension; in FIG. 6, hole 72 is of relatively larger horizontal dimension but equal vertical dimension; and, in FIG. 7, hole 74 is of equal vertical dimension and of even larger horizontal dimension. It is presently preferred that about one eighth inch of vertical adjustment and horizontal ranges of about three eighths inch, one quarter inch and one eight inch, respectively, be provided for the upper, middle and lower mounts. To achieve these spans of adjustment, holes 32, 70, 72 74 must of course be larger across each such dimension by the diameter of bolt 24. Larger ranges should be applied in coarse constructions and smaller ranges will suffice for more detailed work. This range of sizes for the respective upper, middle and lower adjustment holes permits adjustment of the relative position of body 20 vertically and horizontally with respect to the axis of the three hinges as defined by hinge pins 42, within a reasonable range. Use of three different horizontal ranges guards against unnecessarily adjusting the body and the hinge axis away from one another while correcting alignment. It will be appreciated that as the building settles and doorjamb 50 is caused to lean one way or another, the axis defined by the hinge pins 42 will also lean. Door body 20 will then tend to swing into whichever position at which its mass is at lowest elevation. Using the adjustable mounts of the invention, the alignment of the hinging axis can be adjusted using adjustable mounts on the jamb, and/or the position of the door with respect to the hinge axis can be adjusted using adjustable mounts on the door. In order to correct the tendency of the door to swing open or closed, the hinge axis as well as the horizontal position of the top of the door, and to a lesser extent the position of the bottom of the door, may be adjusted by employing the varied horizontal adjustment spans in oversized holes 70, 72, 74. Inasmuch as it is difficult to predict the directions a doorjamb will lean as a building settles, notches 32 are located in the center of the horizontal adjustment span. Adjustment requires simply loosening bolts 24, re-positioning the mounting bracket and re-tightening bolts 24.

As noted above, the hinge mounts are preferably secured in a starting position using notches 32 before the door is mounted. The door and/or jamb brackets are initially mounted at one end of their range of vertical adjustment. Each of the hinge mounts are referenced to notches 32, centered in aligned adjustment holes 30. Each of the hinge leaves 40 is automatically set to position each of the hinge pins 42 in the same axis with respect to both door and jamb, by virtue of centering notches 32. The jamb is preferably built to set the axis defined by the hinge pins 42 as nearly vertical as possible, whereby the door as centered will tend to remain open when opened and will tend to remain closed when closed but not latched.

To correct misalignment of the door due to out of plumb construction or settling in the building, the craftsman loosens bolts 24 slightly, repositions the door as required by rapping against the door body in the required direction, and retightens the bolts. Misalignment is therefore correctable by desired increments until the complete span of adjustment holes 32 is used, and the door may be repeatedly adjusted until that point is reached without the necessity of remounting the hinge leaves to the mounting brackets or to the door or jamb and without planing the door. It will be appreciated that the centering and aligning effect of notches 32 is lost once the door is moved such that bolts 24 are free of the notches. Nevertheless, until that point is reached, the apparatus has the advantages of a factory-installed pre-hung door as well as the capability of adjustment where required.

Variations on the inventive concept are possible and will become apparent to those skilled in the art in light of this disclosure. Reference should be made to the appended claims rather than the foregoing specification as indicating the true scope of this invention.

What is claimed is:

1. An adjustable hinge mount for hingeably connected bodies such as a door and doorframe, the door to be rotatably attached to the frame by a hinge having hinge leaves, at least one leaf to be rigidly attached to a mounting bracket and the bracket to be adjustably attached to the body of at least one of the door and doorframe, the mount comprising:

a body defining an enclosed area;

a mounting bracket positionable against the body within the enclosed area, the mounting bracket having means for rigidly attaching the hinge leaf thereto, the enclosed area having a cavity encompassing the mounting bracket as well as clearance for a span of vertical and horizontal movement of the mounting bracket; and, a plurality of mounting bolts for adjustably attaching the mounting bracket to the body, the bolts extending through the mounting bracket and through the body via adjustment holes in said body, the adjustment holes having a periphery larger than the bolts to allow a span of vertical and horizontal movement, notches in the periphery of the adjustment holes dimensioned to rest against the bolts, indicating a known alignment of the mounting bracket with respect to the body, the bolts operable to rigidly attach the mounting bracket to the body at the known alignment and at alignments within the span of vertical and horizontal movement.

2. The adjustable mount of claim 1, wherein the body has an opening for flush-mounting the hinge leaf, the opening dimensioned larger than the leaf to allow said vertical and horizontal adjustment, the mounting bracket extending beyond the opening and positionable against the body inside the enclosed area, the mounting bracket having a segment for attachment to the hinge leaf and flanges attached to the segment and extending beyond the opening, the flanges being attachable to the body via said bolts.

3. The adjustable mount of claims 1 or 2, wherein the bolts are attached to the mounting bracket by threaded nuts attached to said mounting bracket.

4. The adjustable mount of claim 1, wherein said adjustment holes in the body are substantially rectangular and longer in a horizontal direction than in a vertical direction, the adjustment notches being centered in a horizontal edge of the adjustment holes.

5. The adjustable mount of claim 1, wherein a plurality of hinges, mounting brackets and adjustment holes are provided along the hinged edge of at least one of the door and door frame, the adjustment holes for the upper mounting brackets being larger in horizontal dimension than the adjustment holes for the lower mounting brackets.

6. In an adjustably mountable door assembly for hingeably attaching a pair of bodies, comprising a plurality of hinges having hinge leaves, at least one of said bodies to be adjustably attached to the hinge leaves, the at least one body defining an enclosed area and having an opening along an edge thereof for receiving the hinge leaves, each hinge leaf having an associated mounting bracket disposed in the enclosed area and rigidly attachable to the hinge leaf, and, means for adjustably securing the mounting brackets to the door body, said means having a range of vertical and horizontal adjustment, the improvement comprising:

means for tactilely indicating a known alignment of the respective mounting brackets relative to the at least one body and to one another.

7. The door assembly of claim 6, wherein said means for adjustably securing the mounting bracket to the at least one body comprises mounting bolts extending through oversized holes in the at least one body, the oversized holes having notches dimensioned to rest against the bolts, thereby indicating the known alignment.

8. The door assembly of claim 7, wherein the oversized holes are rectangular, a horizontal edge being at least as long as a vertical edge, the notches being formed in the horizontal edge thereof.

9. The apparatus of claims 1 or 7, wherein the adjustment holes are notched at at least one of an upper and lower horizontal edge thereof.

* * * * *